US005106519A

United States Patent [19]

Mauthner et al.

[11] Patent Number: 5,106,519

[45] Date of Patent: Apr. 21, 1992

[54] CONDITIONING ADDITIVE FOR METAL WORKING BATH

[76] Inventors: Thomas Mauthner, 17309 Doris La., Livonia, Mich. 23451; Jack Courier, 23451 Cliffview Ct., Farmington Hills, Mich. 48024

[21] Appl. No.: 634,779

[22] Filed: Dec. 27, 1990

Related U.S. Application Data

[63] Continuation of Ser. No. 344,672, Apr. 28, 1989, abandoned.

[51] Int. Cl.[5] ..... C10M 173/02; C10M 173/00

[52] U.S. Cl. ..... 252/49.3; 252/49.5; 252/49.7; 252/51.5 R; 72/42

[58] Field of Search ..... 252/49.3, 49.5; 72/42

[56] References Cited

U.S. PATENT DOCUMENTS

| | | | |
|---|---|---|---|
| 4,313,837 | 2/1982 | Vukasovich et al. | 252/49.5 |
| 4,564,461 | 1/1986 | Skold et al. | 252/32.5 |
| 4,834,891 | 5/1989 | Eguchi et al. | 252/28 |

*Primary Examiner*—Prince E. Willis
*Assistant Examiner*—Ellen M. McAvoy
*Attorney, Agent, or Firm*—Krass & Young

[57] ABSTRACT

A conditioning additive for an oil-in-water emulsion metal working bath includes a copper-amine complex and may further include a molybdenum-amine complex. The complexes may comprise the reaction product of alkanolamines and salts of the metals. The additive may further include pH stabilizing agents, wetting agents, corrosion inhibitors, emulsifiers and surfactants. The additive inhibits microbial growth, stabilizes the emulsion, improves lubricity, prevents corrosion and improves the finish of parts produced therewith.

35 Claims, No Drawings

CONDITIONING ADDITIVE FOR METAL WORKING BATH

This is a continuation of co-pending application Ser. No. 344,672 filed on Apr. 28, 1989, now abandoned.

FIELD OF THE INVENTION

This invention relates generally to oil-in-water emulsion metal working baths and in particular to additives for conditioning and maintaining such baths. Specifically, the present invention relates to conditioning additives including therein amine complexes of copper and molybdenum, useful for conditioning metal working baths.

BACKGROUND OF THE INVENTION

The metal working industry utilizes large amounts of oils to assist in the forming of metal parts. Such oils are generally utilized in the form of what is referred to as soluble or emulsifiable oils, employed in the form of oil-in-water emulsions. These emulsions typically contain 80-99% water and are employed as cutting fluids, coolants and lubricants in machining, grinding, drilling, pressing or other metal working applications. The oil used is usually napthenic base, low to medium viscosity and generally includes approximately 10–30% of emulsifiers, rust inhibitors and various other ancillary ingredients. These oils and emulsions are well-known to those of skill in the art and need not be elaborated upon in any greater detail herein.

In most large-scale metal working operations, metal working fluids are collected and recycled, typically in large tanks or pits. Debris is filtered or skimmed therefrom, other impurities removed and the fluids are returned to service. Problems occur owing to various chemical changes in metal working fluids, which changes detrimentally affect the function of the fluids.

The oil-in-water emulsion can provide an ideal growth medium for bacteria, algae or other microbes and such biological contamination is one major source of metal working bath contamination. Biological contamination can result in loss of lubricating power, breaking of the emulsion and separation of the bath into aqueous and oily components. Microbial contamination can also cause the generation of noxious odors and decomposition of the components of the bath. Contamination can result in a cycle of bath degradation; bacteria attack the emulsifiers degrading bath lubricity and breaking the emulsion; furthermore, bacterial growth generates hydrogen sulfide or other sulfur bearing compounds which corrode metal parts, provide a health hazard and serve to reduce the pH of the metal working bath. The reduced pH in turn causes further emulsion breakdown and the sulfides can nourish the growth of algae further degrading bath performance. Such contamination can result in a runaway cycle which can damage expensive equipment and which inevitably necessitates costly disposal of contaminated baths. The addition of strong bases to contaminated baths only temporarily raises the pH. The contaminating organisms quickly generate more acidic sulfide compounds further degrading the bath.

In many instances, sulfur or sulfur containing additives are added to the cutting oils to improve lubricity, machinability and subsequent finish of processed articles. The addition of free sulfur causes the formation of sulfides at a very speedy rate and these types of cutting oils have a historically short life span. Use of the additive of the present invention greatly retards sulfide formation and greatly extends the life of the bath.

Many attempts have heretofore been made to control the growth of organisms in metal working baths. For example, U.S. Pat. No. 3,244,630 discloses the introduction of iodine vapor into a metal working bath for control of micro organisms. Iodine is toxic, hard to handle and corrosive to a variety of metals. Furthermore, iodine can chemically react with and degrade bath components. Consequently, this method has not found widespread acceptance.

U.S. Pat. No. 3,365,397 discloses another prior art approach to microbial contamination of metal working baths which relies upon the use of phenol as a bactericide. Phenol is a toxic compound and furthermore is of limited bactericidal use, since there are a variety of micro organisms which can metabolize phenol.

U.S. Pat. No. 3,240,701 discloses the use of aminoacetic acid compounds such as diethylenatriamine pentaacetic and 1, 2-diaminocyclohexamine tetraacetic acid chelates of metal ions. These compounds are utilized to inhibit the growth of bacteria; however, they have the undesirable property of reacting with zinc which is often present in the metal working baths. This is a significant problem since lubricating oils are frequently enhanced with zinc containing additives such as zinc dialkyldithiophosphate (ZDTP). Such ZDTP additives enhance the lubricity and antiwear properties of the oil. Zinc containing lubricating oils frequently leak into cutting oil baths. Presence of zinc chelating compounds is obviously undesirable in stabilizers or additives, for metal working fluids.

U.S. Pat. No. 4,129,509 discloses the use of complexes of copper ion with polyhydroxy compounds such as citric acid, for purposes of inhibiting microbes. As is set forth in the specification thereof, these complexes exhibit a sigmoidal decomposition over a varying pH range wherein the decomposition of the complex, and subsequent release of metal, increases very sharply over a given portion of the pH range. The complexes of the '509 patent also suffer from the shortcomings of complexing zinc and are therefore limited in utility.

From the foregoing it should be clear that there is a need for a metal working fluid additive which functions to inhibit the growth of undesirable microbes in an oil-in-water bath. It is further desirable that any such compound be of low toxicity, easy to handle, non-corrosive to metals and non-chelating of zinc. In general, the additives of the present invention include complexes formed from the reaction of copper salts with alkanolamines as well as the reaction product of molybdenum salts with alkanolamines. Such compounds exhibit high levels of microbial inhibition and furthermore are non-corrosive, easy to handle and of low toxicity. Most importantly, the copper and molybdenum containing complexes of the present invention do not chelate zinc. This selective chelating ability makes the present invention very useful with all currently employed metal working fluids.

The use of alkanolamine complexes of copper for the control of algae in streams and other bodies of water is shown in U.S. Pat. No. 2,734,028; however, there is no teaching whatsoever in that patent of the use of such compounds in conjunction with metal working fluids, nor is there any teaching or suggestion of the use of molybdenum complexes for any purpose whatsoever.

The present invention fulfills a long-felt need for a low-cost, safe, non-corrosive and simple to use conditioning additive which is compatible with a wide variety of metal working baths, particularly zinc contaminated baths. These and other advantages of the present invention will be presently apparent from the discussion, examples and claims which follow hereinbelow.

SUMMARY OF THE INVENTION

There is disclosed herein a zinc contamination tolerant additive for an oil-in-water emulsion metal working bath which additive comprises an aqueous solution of the reaction product of a salt of copper and an alkanolamine as well as the reaction product of a salt of molybdenum and an alkanolamine. In one embodiment, the reaction product of the salt of copper and the alkanolamine is the reaction product of at least two moles of alkanolamine and one mole of copper salt; similarly, the molybdenum containing reaction product may be the reaction product of at least two moles of alkanolamine and one mole of the salt of molybdenum.

The molybdenum salt may be a salt of molybdic acid such as ammonium molybdate. The salt of copper may be selected from the group consisting essentially of copper sulfate, copper nitrate, copper chloride, and copper acetate. And the alkanolamine may be selected from the group consisting essentially of ethanolamine, diethanolamine, triethanolamine and combinations thereof.

The additive may further include potassium borate and/or potassium hydroxide and/or wetting agents and/or surfactants.

The copper containing compound may be present in approximately 5–15 weight percent and the molybdenum containing compounds may be present in approximately 0.1–1% weight concentration. The additive may include other ingredients such as phosphate esters, pyrophosphates and the like.

The present invention also includes a method of conditioning an oil-in-water emulsion metal working bath comprising the steps of adding to the bath 10–100 parts per million of copper in the form of a reaction product of a salt of copper and an alkanolamine and 1–10 parts per million of molybdenum in the form of the reaction product of the salt of molybdenum and an alkanolamine. In one preferred embodiment, the method comprises adding approximately 40–60 parts per million of copper and 4–6 parts per million of molybdenum to the bath. The method may also include the further step of maintaining the pH of the bath at a value of greater than 8.5 and toward this end can include the step of adding a pH stabilizer to the bath. The method may include the further steps of adding at least 0.01 weight percent of a wetting agent to the bath and at least 0.05 weight percent of a nonionic surfactant to the bath.

DETAILED DESCRIPTION OF THE INVENTION

The present invention concerns zinc compatible additives for oil-in-water type emulsion metal working baths. The additives inhibit microbial growth in the baths and include a source of copper in the form of a copper-amine complex, most preferably a complex of a copper salt and an alkanolamine. Compounds of this type are stable, easy to handle and have good solubility properties in the oil-in-water emulsions.

One particularly preferred copper complex is the complex of a copper containing salt such as copper sulfate, copper nitrate, copper chloride, copper acetate and the like together with an alkanolamine such as mono, di or tri ethanolamine. Similarly, other alkanolamines such as propanolamines and the like may be similarly employed. Also, nonhydroxyl alkyl and aryl amine compounds may in some instances have similar utilities.

It is most preferred to employ a complex of copper sulfate and triethanolamine generally in the ratio of approximately two moles of amine to one mole of copper salt. Although the copper compound may be utilized by itself, it has been found that adding a molybdenum-amine complex together with the copper complex increases the rustiinhibition properties of the metal working bath, particularly on freshly ground metal shavings. The molybdenum amine complexes are generally similar to the copper complexes in terms of amine components and molar proportions. There are a variety of water soluble molybdenum salts which may be employed; however, for reasons of convenience it has been found most advantageous to employ salts of molybdic acid. Ammonium molybdate is one such salt readily available and as will be described hereinbelow may be readily complexed with the amines.

Preparation of the Copper Complex

The copper complex may be prepared from a variety of materials as set forth hereinabove, and under a variety of conditions which will be obvious to one of skill in the art. One method for preparation of the complex proceeded as follows:

360 pounds of 85% purity commercial grade triethanolamine was dissolved in 390 pounds of water maintained at 160° F. in tank No. 1. In tank No. 2, 250 pounds of copper sulfate —5 $H_2O$ (98.6% purity) was dissolved in 337 pounds of water at 160° F. Over a period of about 30 minutes, the copper sulfate solution was introduced into the triethanolamine solution with stirring. The temperature was maintained at 160° F. After all the copper sulfate had been added, stirring was continued for an additional 30 minutes when 45 pounds of diethanolamine was added. After an additional 60 minutes of mixing, the batch was weighed and assayed. The total yield was 1,382 pounds of solution having a copper content of 4.52%. The triethanolamine-copper ratio was approximately 2-1 mole with a very slight excess of triethanolamine. The pH of the resultant solution was 9.84 and presented a stable form of triethanolamine-copper complex stabilized with diethanolamine.

The copper complex thus prepared is capable of releasing copper into solution and the amount of released copper is found to increase relatively monotonically with increasing pH. This is in contrast to behavior of copper-polyhydroxyacid compounds such as those of the U.S. Pat. No.4,129,509 which exhibit a sigmoidal pH dependent decomposition.

Tests of the foregoing copper compound was carried out on emulsions comprised of 5% commercial grade soluble oil in 95% water. Six emulsions were prepared; three were used as a control and to the other three the equivalent of 10, 20 and 30 milligrams/liter of copper (as Cu) was added in the form of the foregoing solution. The solutions were automatically mixed for 120 seconds every hour. The initial pH of all six solutions was 9.12, however, after three days the untreated solutions began to develop odor and a corresponding decrease in pH. The bacteria count in the untreated solutions after six days was measured at $10^7$ using Ames Biostixreagent strips, and the pH of these samples dropped to 8.24. The copper treated solutions in contrast showed no odor, no bacteria count and the pH was 8.78.

In practical tests carried out in actual fluids employed in conjunction with the machining of cast iron it was found that at little as 10 PPM copper introduced in the form of a copper-amine complex prevented the usual bacterial growth and sulfide formation. It has further been found that when amounts of copper in excess of 30 PPM (preferably between 40–60 PPM) were employed the emulsion stability greatly increased. The oil droplets were smaller than in untreated baths and the soluble oil was found to form a more perfect film on the freshly machined metal and the ground chips. It was further found that the copper amine complex, or at least the copper portion of the complex dissolves into, or becomes part of the oil portion of the emulsion. Analytical tests involving measurement of the partition of the copper between the oil and water component of the bath confirms that at least 80% of the copper resides in the oil and stabilizes the emulsion.

The Molybdenum-Amine Complex

The molybdenum-amine complex may be prepared from the various materials described hereinabove and methods for its preparation will be obvious to one of skill in the chemical art. However, one particularly useful complex was prepared as follows:

350 pounds of triethanolamine (85% pure commercial grade) and 220 pounds of water were charged into a tank and heated to 160° F. In a second tank 205 pounds of ammonium molybdate (85% molybdic acid having a theoretical formula of: $(NH_4)_2Mo_2O_7$)) was dissolved in 300 pounds of water maintained at 160° F. The ammonium molybdate solution was slowly introduced into the triethanolamine solution. The temperature was maintained at 160° F., the solution agitated for an hour, then weighed and assayed and found to contain 9.06% Mo.

It has been found that metal working solutions containing both the copper and molybdenum additives showed marked improvement in rust prevention capability as compared to untreated solutions. Cast iron shavings covered with a soluble oil emulsion generally rusted within 24 hours while an emulsion including 40–60 parts per million of copper and 4–6 parts per million of molybdenum in the form of the amine complexes extended the rust free period for over seven days.

Even though the hereinabove described copper-molybdenum amine complex additive suppressed microbial growth, eliminated odor formations, prevented rust and stabilized the emulsions it was still found that some lowering of the pH of the metal working bath occurred, albeit at a lower rate. It has further been found that addition of a suitable buffer together with the Cu—Mo complex helps to stabilize the pH and the resultant additive eliminated most of the common problems associated with these baths.

There are a wide variety of buffering agents available and usable with the present invention including sodium tetraborate (Borax) and potassium borate. Potassium borate has been found to be particularly advantageous as a pH stabilizer since it is of high solubility and is chemically compatible with the Cu—Mo amine complex. It has further been found that addition of relatively small amounts of potassium hydroxide imparts an optimum pH to the metal working bath and acts to prevent crystalization of the potassium borate. In general, it has been found that a metal working fluid bath conditioner can be made from an aqueous solution of approximately 5–15 weight percent of the copper amine complex, approximately 0.1–1 weight percent of the molybdenum amine complex, approximately 5–15 weight percent of potassium borate and approximately 0.1–1 weight percent of potassium hydroxide. This composition provides a conditioner which is added to the soluble oil bath in approximately 1% volume.

A particular additive composition was prepared as follows, with all percents being given by weight:

| | |
|---|---|
| Water | 79.0% |
| Potassium Borate | 10.0% |
| Cu-Amine Complex | 10.0% |
| Mo-Amine Complex | 0.5% |
| Potassium Hydroxide | 0.5% |

Addition of 1% of the conditioner to the soluble oil bath produced measured levels of approximately 0.1% potassium borate, approximate 50 PPM copper and 5 PPM molybdenum. The pH of the bath was 9.3 and after five days (80 working hours) the pH had dropped to only 9.1. It was found that this bath remained stable and needed only periodic additions of the conditioner complex when further oil and water was added to the bath.

An additional advantage of the abovereferenced composition is that a further increased rust inhibition is still further increased. In a test, cast iron shavings were placed in a Petri dish approximately one-half inch deep and covered with a soluble oil emulsion right after machining. These chips were rusted over 50% before 48 hours. When the experiment was repeated utilizing a soluble oil emulsion including only the Cu—Mo amine additive it was found that practically no rust appeared for eight days after which time the chips slowly picked up oxide. When the experiment was repeated again utilizing a soluble oil emulsion including 1% of the foregoing composition it was found that the chips did not rust for 25 days and even after that, the rust appeared very slowly when the chips were exposed to air at room temperature.

It has further been found that the addition of surfactants and/or wetting agents to the aforementioned compositions further increases their efficiency by facilitating wetting of chips and fragments of metal. Nonionic surfactants for example, are useful additions to the aforementioned additives. Among said surfactants are alkylphenol-ethylene oxide adducts as well as primary or secondary alcohol ethoxylates. One particularly preferred surfactant is an alkylphenol ethylene oxide adduct wherein the alkyl chain is between 8 and 13 carbons long and the adduct includes 7–12 moles of ethylene oxide.

Additions of wetting agents still further increase the performance of the bath additive. There are available to those of skill in the art a great variety of wetting agents and it has been found that wetting agents characterized as having a fast skein wetting time of less than 30 seconds at a concentration of 0.1% or lower, when tested according to the DravesClarkson method are particularly preferred. One wetting agent meeting this standard is the sodium salt of dioctyl sulfosuccinate. This material has a Draves sinking time of six seconds at a 0.25% concentration.

In general, it has been found that a minimum of 0.5% of the nonionic surfactant and 0.01% of the wetting agent are necessary in order to confer desirable properties upon the metal working fluid bath.

A particular additive composition included the following weight percentages of reagents:

| | |
|---|---|
| Water | 73.0% |
| Potassium Borate | 10.0% |
| Cu-Amine Complex | 10.0% |
| Mo-Amine Complex | 0.5% |
| Nonionic Surfactant | 5.0% |
| Sodium Dioctyl Sulfosuccinate | 1.0% |

The nonionic surfactant was a product sold under the trade name Igepal CO 630 by the GAF Corporation and may be generally characterized as an alkylphenol ethylene oxide adduct.

As in the foregoing example, 1.0% of the additive preparation was added to a soluble oil both containing 4.5% of soluble oil. Wetting ability of the resultant treated bath was assessed by pouring 25 milliliters of the bath into a Petri dish having 200 grams of freshly ground cast iron chips arranged in a mound therein with a 4–5 inch base diameter and a quarter inch top diameter. It was shown that all of the treated oil was absorbed onto the surface of the chips within 120 seconds. When the experiment was repeated utilizing a similar composition lacking the surfactant and wetting agent, it was found to take 15–30 minutes for the oil to be completely absorbed onto the chips.

The chips thus treated were dried and stored exposed to air. There was no visible rust on the chips for 60 days. When a similar body of chips were treated with a soluble oil emulsion not having the aforementioned additives it was found that rust appeared within 48 hours and covered over 50% of the surface of the chips.

Further materials may be utilized in the additives to confer additional properties to the metal working bath. For example, it has been found that addition of a water soluble phosphate ester still further increased the lubricity of the oil. It has been found that any one of a member of the series of alkyl and alkylaryl (ethylenoxy) phosphate esters may be so employed. In general, such materials may be characterized as partial phosphate esters of an ethylene oxide adduct of a hydrophobic carbon chain. Typical of these materials is a product sold by the GAF Corporation under the name Antara LP 700; one of skill in the art could obviously select an equivalent material from the many commercially available.

In those instances where grinding and machining of aluminum, copper and other non-ferrous materials is carried out, it has been found that various additives further increase baths, performance. For example, it has been found that addition of a pyrophosphate compound improves the appearance of aluminum, copper and alloys made of these materials. Furthermore, an addition of the sodium salt of 2-mercapto benzothiazole, manufactured and sold by the RT Vanderbilt Company left the freshly processed metal surfaces passive to oxidation. In general, it has been found that an additive composition including approximately 1–10% of the phosphate ester, 1–10% of the pyrophosphate and approximately 0.5–5% of the 2-mercapto bienzothiazole salt gave an additive which greatly enhanced the stability and properties of metal working baths used in conjunction with non-ferrous metals.

A particular composition in accord with these principles was prepared including weight percents of the following:

| | |
|---|---|
| Water | 63.0% |
| Potassium Borate | 10.0% |
| Cu-Amine Complex | 10.0% |
| Mo-Amine Complex | 0.5% |
| Potassium Hydroxide | 0.5% |
| Nonionic Surfactant | 5.0% |
| Na-Dioctyl Sulfosuccinate | 1.0% |
| Antara LP 700 | 4.0% |
| 2-Mercapto Benzothiazole-Na | 2.0% |
| Tetrapotassium Pyrophosphate | 4.0% |

This additive, when added to a metal working soluble oil emulsion in approximately 1% concentration conditions the bath so as to eliminate odor, reduce bacterial growth, stabilize the emulsion, improve lubricity, inhibit corrosion, and stabilize pH fluctuation thereby improving the performance of life of the bath, as well as preserving the freshly ground chips from oxidation and improving the machining of all non-ferrous metals. This particular composition may be utilized in combination with a variety of metal working baths and because of the selective chelating ability of the organic materials utilized in the metal-amine complexes, does not interfere with zinc additives in the metal working baths.

While the aforegoing additive compositions have been described in terms of aqueous solutions added to metal working baths at approximately 1% concentration, it will of course be appreciated that such additive compositions may be made more or less concentrated and accordingly added to metal working baths in greater or lesser amounts. For this reason, the various proportions given herein are to be considered relative and merely representative of rough amounts of the components. In general, it has been found that a metal working bath should be conditioned by the inclusion of between 10–100 parts per million and more preferably 40–60 parts per million of copper in the form of the Cu-amine complex of the present invention. The bath should further include approximately 1–10 parts per million, and preferably 0.1–1 part per million of the Mo-amine complex. The pH of the bath should be maintained at values equal to or greater than 8.5 and toward that end it is preferable that the bath include at least 0.1% of a pH stabilizing material such as potassium borate and optionally about 0.1% by weight of potassium hydroxide. As mentioned hereinabove, the bath may also include 0.01% by weight of a wetting agent and 0.05% by weight of a nonionic surfactant.

It has been found advantageous in many instances to include an emulsifier in the additive, particularly when further replenishment of the oil component of the bath is anticipated, or when accumulations of tramp oil build up in the bath necessitating emulsification thereof.

There are a great many emulsifiers available for use in oil-in-water emulsions of the types discussed herein, and one of skill in the art could readily select an emulsifier for inclusion in the additive of the present invention. One particular group of emulsifiers having significant utility are the alkylphenols, typified by ethyoxylated nonylphenol. Such materials are available from a variety of suppliers including the Steppen Chemical Company which sells an ethyoxylated nonylphenol emulsifier under the tradename Makon.

It has been found that emulsifiers of this type, typically, in amounts of 1–4 parts per thousand can disperse up to ten times their volume in oil.

In light of the foregoing, it will be apparent that many variations of the foregoing compositions may be employed to condition metal working baths in keeping with the basic principle of the present invention; namely, that Cu-amine complexes are advantageously employed to limit microbial growth in metal working baths of the oil-in-water emulsion type. The foregoing discussions and examples are merely meant to be illustrative of the general principles of the present invention and not to be limitations upon the practice thereof., It is the following claims, including all equivalents, which define the scope of the invention.

We claim:

1. A zinc-compatible, biocidal, noncorrosive additive for an oil-in-water emulsion, metal working bath, said additive comprising an aqueous solution of:

the reaction product of a salt of copper and an alkanolamine; and the reaction product of a salt of molybdenum and an alkanolamine, whereby the inclusion of the molybdenum salt reaction product in the additive provides for enhanced corrosion inhibition properties.

2. An additive as in claim 1, further including potassium borate.

3. An additive as in claim 1 wherein the reaction product of the salt of copper and the alkanolamine is a reaction product of at least two moles of alkanolamine and one mole of the copper salt.

4. An additive as in claim 1, wherein the reaction product of the salt of molybdenum and the alkanolamine is the reaction product of at least two moles of alkanolamine and one mole of the salt of molybdenum.

5. An additive as in claim 1, wherein the weight percent of the reaction product of the copper salt is at least ten times the weight percent of the reaction product of the molybdenum salt.

6. An additive as in claim 1, further including potassium hydroxide.

7. An additive as in claim 1, wherein the salt of copper is selected from the group consisting of: copper sulfate, copper nitrate, copper chloride, and copper acetate.

8. An additive as in claim 1, wherein the salt of molybdenum is ammonium molybdate.

9. An additive as in claim 1, wherein said alkanolamine is selected from the group consisting of: ethanolamine, diethanolamine, triethanolamine and combinations thereof.

10. An additive as in claim 2, wherein said reaction product of the salt of copper and the alkanolamine is present in an approximately 5–15% weight concentration; the reaction product of the molybdenum salt and the alkanolamine is present in an approximately 0.1–1 % weight concentration; and the potassium borate is present in an approximately 5–15% weight concentration.

11. An additive as in claim 1, further including a non-ionic surfactant.

12. An additive as in claim 11, wherein said non-ionic surfactant is selected from the group, consisting of: alkylphenol ethylene oxide adduct, primary alcohol ethoxylates, secondary alcohol ethoxylates, and combinations thereof.

13. An additive as in claim 11, wherein said non-ionic surfactant is an alkylphenol ethylene oxide adduct wherein the alkyl chain is 8–13 carbons long and the surfactant includes at least 7 moles of ethylene oxide per mole of alkylphenol.

14. An additive as in claim 1, further including a wetting agent.

15. An additive as in claim 14, wherein said wetting agent is characterized by having a fast skein wetting time of less than 30 seconds at a maximum concentration of 0.1%, when tested by the Draves-Clarkson method.

16. An additive as in claim 15, wherein said wetting agent is the sodium salt of dioctyl sulfosuccinate.

17. An additive as in claim 10, further including 2–10 percent by weight of non-ionic surfactant and 0.5–1.5% by weight of a wetting agent.

18. An additive as in claim 1, further including a soluble phosphate ester.

19. An additive as in claim 18, wherein said soluble phosphate esther is a partial phosphate esther of an ethylene oxide adduct of a hydrophobic chain.

20. An additive as in claim 1, further including a pyrophosphate.

21. An additive as in claim 1, further including the sodium salt of 2-mercapto benzothiazole.

22. An additive as in claim 17, further including 2–8 % by weight of a partial phosphate esther of an ethylene oxide adduct of a hydrophobic chain, 1–3% by weight of 2-mercapto benzothiazole-sodium salt and 2–8% of tetrapotassium pyrophosphate.

23. An additive as in claim 1, ,further including an emulsifier.

24. An additive as in claim 24, wherein said emulsifier includes an ethoxylated nonylphenol.

25. A method of conditioning an oil-in-water emulsion metal working bath comprising adding to said bath:

10–100 parts per million of copper in the form of the reaction product of a salt of copper and an alkanolamine; and 1–10 parts per million of molybdenum in the form of the reaction product of the salt of molybdenum and an alkanolamine.

26. A method as in claim 25, comprising the further steps of:

selecting said copper salt from the group consisting of: copper nitrate, copper chloride, copper sulfate and copper acetate;

selecting a salt of molybdic acid as said salt of molybdenum; and selecting said alkanolamine from the group consisting of: ethanolamine, diethanolamine, triethanolamine and combinations thereof.

27. A method as in claim 25, wherein 40–60 parts per million of copper is added to said bath.

28. A method as in claim 25, wherein 4–6 parts per million of molybdenum is added to said bath.

29. A method as in claim 25, including the further step of maintaining the pH of said bath at a value greater that 8.5.

30. A method as in claim 29, including the further step of adding a pH stabilizer to said bath.

31. A method as in claim 30, wherein the step of adding said pH stabilizer comprises adding at least 0.1% of potassium borate to said bath.

32. A method as in claim 29, including the further step of adding at least 0.1% by weight of potassium hydroxide to said bath.

33. A method as in claim 25, comprising the further step of adding at least 0.01% by weight of a wetting agent to said bath.

34. A method as in claim 25 including the further step of adding at least 0.05% by weight of a non-ionic surfactant to said bath.

35. A method as in claim 25, including the further step of adding an emulsifier to the bath.

* * * * *